US008562376B2

(12) United States Patent
Chen

(10) Patent No.: US 8,562,376 B2
(45) Date of Patent: Oct. 22, 2013

(54) CABLE CONNECTOR ASSEMBLY HAVING A CAPACITOR CONNECTED WITH ONE CONNECTOR AND A METALLIC SHELL

(75) Inventor: Yong-Jun Chen, Shen Zhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/303,026

(22) Filed: Nov. 22, 2011

(65) Prior Publication Data

US 2012/0129397 A1 May 24, 2012

(30) Foreign Application Priority Data

Nov. 22, 2010 (CN) ..... 2010 2 0617701

(51) Int. Cl.
*H01R 13/648* (2006.01)

(52) U.S. Cl.
USPC ..... 439/607.24

(58) Field of Classification Search
USPC ..... 439/607.24, 607.08, 108
See application file for complete search history.

(56) References Cited

U.S. PATENT DOCUMENTS 3,848,164 A * 11/1974 Otte ..... 439/579
4,500,159 A * 2/1985 Briones et al. ..... 439/607.01
6,699,074 B1 * 3/2004 Wu et al. ..... 439/607.08

FOREIGN PATENT DOCUMENTS

CN 2552173 A 5/2003
TW M332301 5/2008
WO WO2006008022 1/2006

* cited by examiner

*Primary Examiner* — Chandrika Prasad
(74) *Attorney, Agent, or Firm* — Wei Te Chung; Ming Chieh Chang

(57) ABSTRACT

A cable connector assembly (100) includes an insulative housing (10) defining a plurality cavities, a first connector (20) received in a cavity, a pair of second connector (30) received in other cavities, a cable electrically connected with the first connector and the second connectors, a metallic shell (40) shielding on the insulative housing and a capacitor (50) defined in the insulative housing. The capacitor is assembled behind the connectors, and includes two linking points (500, 501). The second connector has a plurality of grounding legs (300) electrically connected with each other, one linking point of the capacitor is connected with one of the grounding legs of the second connector, and the other linking point is connected with the metallic shell.

14 Claims, 4 Drawing Sheets

CABLE CONNECTOR ASSEMBLY HAVING A CAPACITOR CONNECTED WITH ONE CONNECTOR AND A METALLIC SHELL

BACKGROUND OF THE INVENTION

1. Field of the Invention

The present invention relates to a cable connector assembly, more particularly to a cable connector assembly with improved grounding means.

2. Description of Related Art

Nowadays, an electronic device is lower profile and multifunctional. So accessories are attached to the electronic device, such as cable connector assembly should be transmitting fast, smaller contour, simplified and friendly usage. USB and Audio jack are commonly input/output interfaces for a computer or other consumer device, and those interfaces are commonly mounted to a cage of a computer or other electronic devices and to link with other peripheral devices.

TW Patent No. M332301 issued on May 11, 2008 discloses a cable connector assembly, the cable connector assembly defines a plurality of USB connectors mounted to a cage of a computer and commonly used for input/output interfaces mating with external complementary connectors. The cable connector assembly comprises a cover composed of a top cover and a bottom cover, the cover defines a plurality of cavities receiving the corresponding USB connectors, therefore the USB connectors are mounted in the cable connector assembly. The cable connector assembly also comprises an external shell enclosing the cover, and the USB connectors further contact the external shell to achieve grounding function. However, the contacting relationship between the connectors and the external shell can not achieve better effect of anti-EMI.

Hence, a cable connector assembly with improved grounding device is desired.

BRIEF SUMMARY OF THE INVENTION

Accordingly, an object of the present invention is to provide a cable connector assembly for suppressing Electrical Magnetic Interference (EMI).

In order to achieve the above-mentioned object, a cable connector assembly in accordance with present invention comprises an insulative housing defining a plurality cavities, a first connector received in a cavity, a pair of second connector received in other cavities, a cable electrically connected with the first connector and the second connectors, a metallic shell shielding on the insulative housing and a capacitor defined in the insulative housing. The capacitor is assembled behind the connectors, and includes two linking points. The second connector has a plurality of grounding legs electrically connected with each other, one linking point of the capacitor is connected with one of the grounding legs of the second connector, and the other linking point is connected with the metallic shell.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
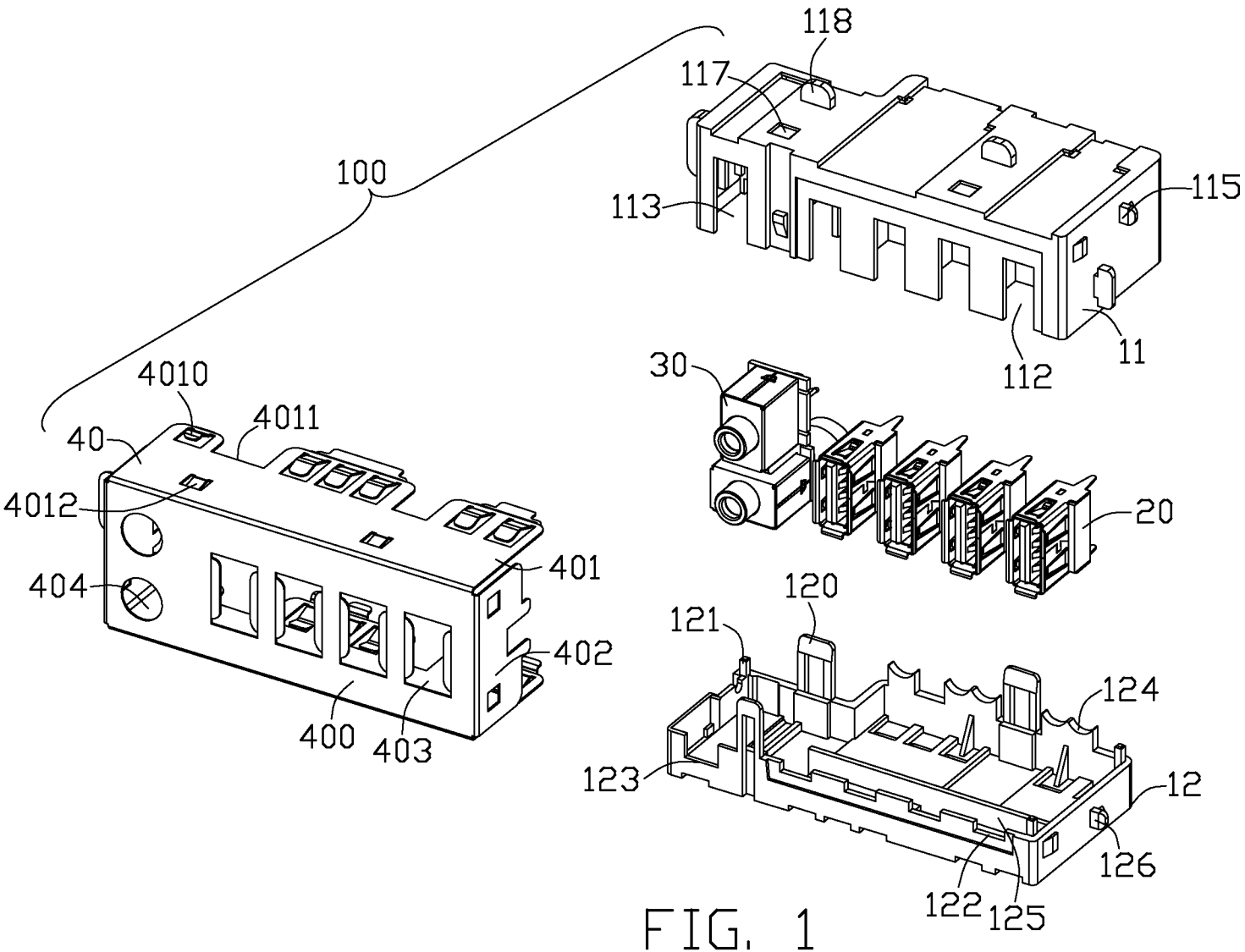
FIG. 1 is an exploded, perspective view of a cable connector assembly.

In the following description, numerous specific details are set forth to provide a thorough understanding of the present invention. However, it will be obvious to those skilled in the art that the present invention may be practiced without such specific details.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-4, a cable connector assembly 100 in accordance with the present invention comprises an insulative housing 10, a number of first connectors 20 receiving in the insulative housing 10, a pair of second connectors 30 and a metallic shell 40 shielding the insulative housing 10. Detail description of these elements and their relationship and other elements formed thereon will be detailed below.

Figure 2:
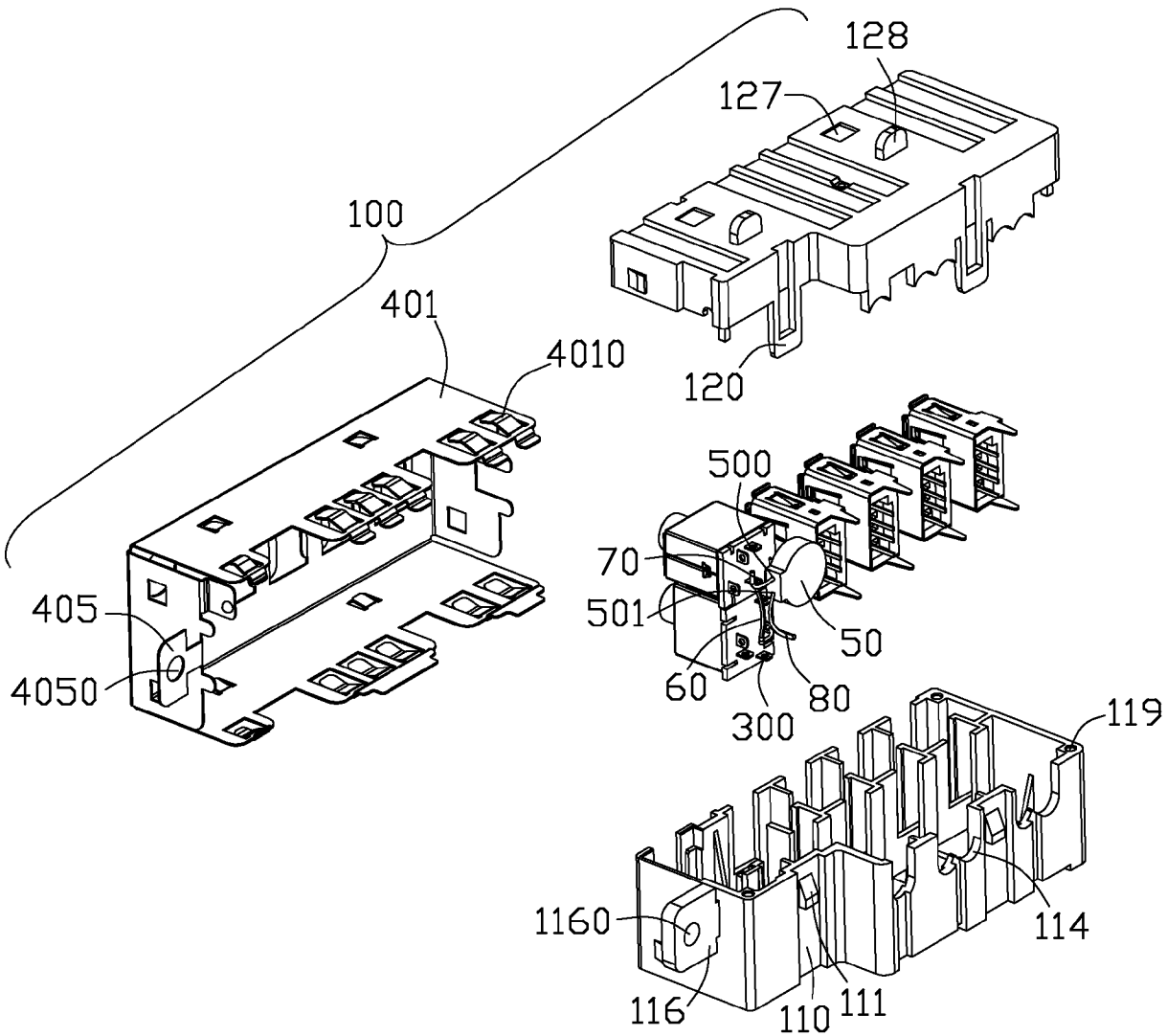
FIG. 2 is similar to FIG. 1, but viewed from other direction.
Figure 3:
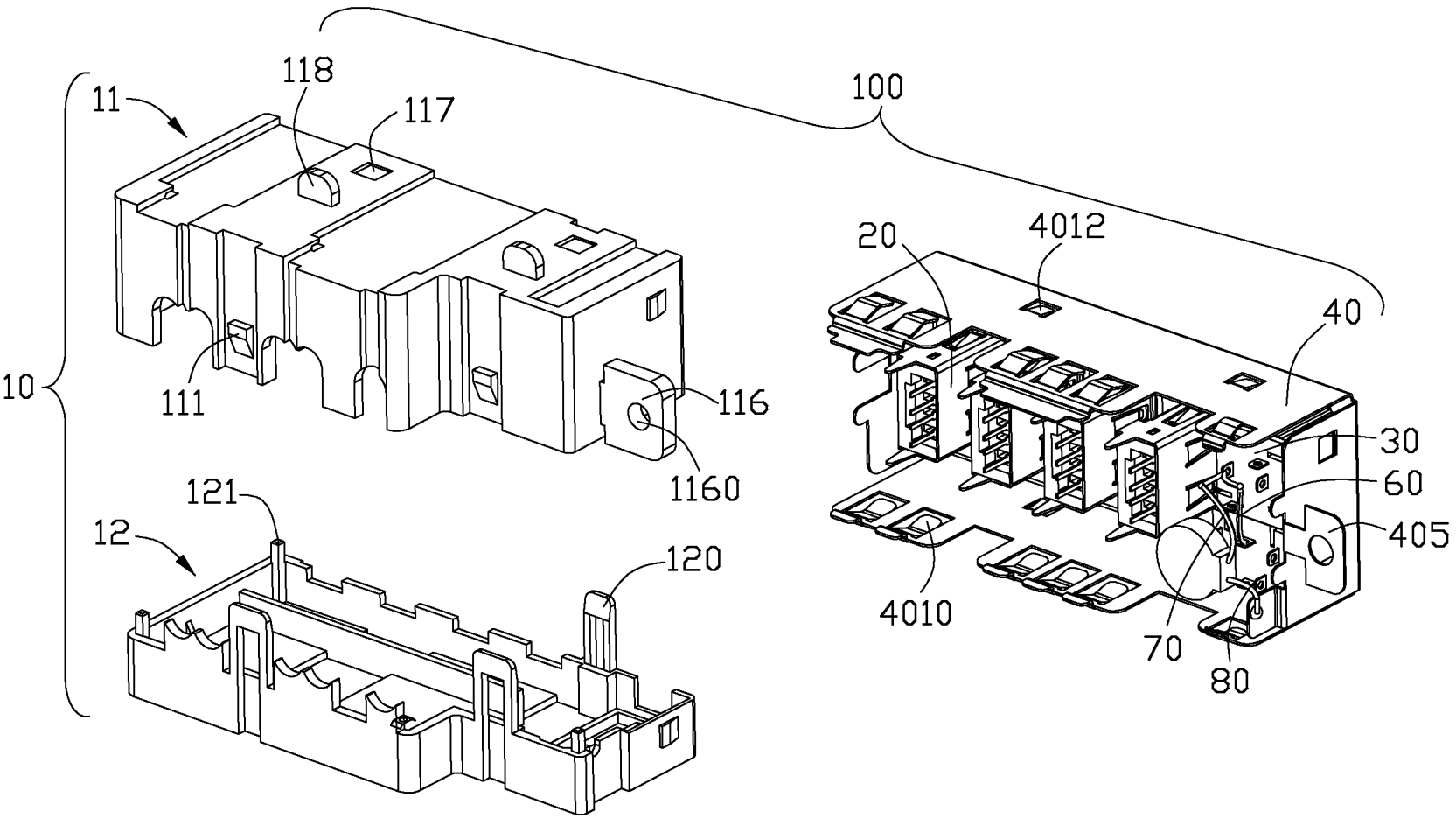
FIG. 3 is a partially assembled, perspective view of the cable connector assembly shown in FIG. 2.
Figure 4:
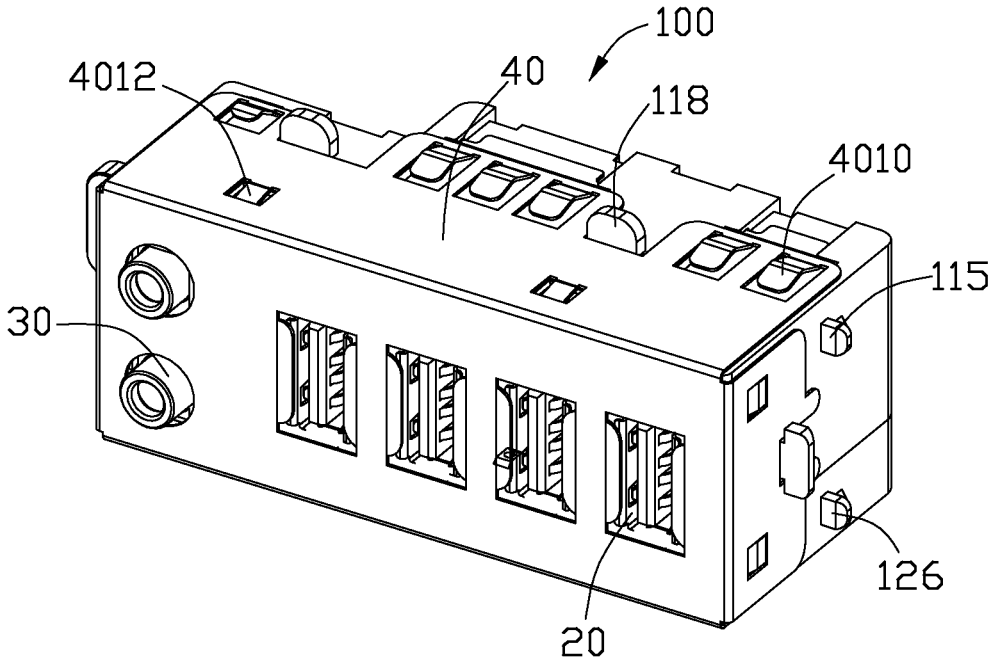
FIG. 4 is an assembled, perspective view of the cable connector assembly shown in FIG. 1.

Referring to FIGS. 1-2, the insulative housing 10 is of rectangular shape, and an elongated front end of the insulative housing is defined as a mating port, and the opposite end of the front end is served as a connecting portion wherein a cable (not shown) extending from. The insulative housing includes a top cover 11 and a bottom cover 12 assembled to the top cover 11. The bottom cover 12 defines a plurality of latch members 120 extending upwards from outer sides of side walls thereof, and three positioning posts 121 are respectively formed in three corners of the bottom cover 12. The bottom cover 12 also has four first cavities 122 used for accommodating the first connectors 20, and the first connectors 20 are arranged in one row along a transverse direction. And the bottom cover 12 also has a second cavity 123 in front segment thereof to receive the second connectors 30, and the two second connectors 30 are stacked with each other and received in the second cavity 123. The bottom cover 12 defines a plurality of first cable outlets 124 receiving the cable electrically connected with the first connectors 20. The bottom cover 12 defines a blocking board 125 along the transverse direction, and the blocking board 125 can settle the first connectors in the bottom cover 12. The bottom cover 12 also has a first rib 126 on a left side surface of the bottom cover 12, and a pair of first sunken portions 127 recessed upwards from a lower surface of the bottom cover 12, a pair of first protrusions 128 are defined behind the corresponding first sunken portions 127.

The top cover 11 has a plurality of openings 110 cooperated with and receiving the corresponding latch members 120 of the bottom cover 12, and each opening 110 defines a tab 111 locked with the corresponding latch members 120. The top cover 11 has a plurality of third cavities 112 assorted with the first cavities 122 of the bottom cover 12 and a fourth cavity 113 conjunct with the second cavity 123 of the bottom cover 12. The top cover 11 has a plurality of second cable outlets 114 in a rear end thereof to cooperate with the first cable outlets 124 of the bottom cover 12. The top cover 11 also has a second rib 115 on a left side surface thereof, and a mounting portion 116 is formed on a right surface of the top cover 11, and a through hole 1160 is defined in a middle area of the mounting portion 116. The top cover 11 defines a pair of second sunken portions 117 recessed downwards from an upper surface thereof. A pair of second protrusions 118 are defined behind the corresponding second sunken portions 117. The top cover 11 defines a plurality of positioning holes 119 in corners thereof receiving the corresponding positioning posts 121.

Referring to FIGS. 1-2, the first connectors 20 of the cable connector assembly 100 are USB connectors, and each first connector 20 has a configuration as usual, and description of the configuration of the first connector 20 is omitted. The second connectors 30 are a pair of audio jacks stacked with each other along an up-to-down direction, and each second connector 30 has a usual configuration. Differently, each second connector 30 has a number of grounding legs 300 extending beyond a rear end of the second connector 30. The grounding legs 300 can be extending from an interior of each second connector 30, and can be formed on an exterior shell of each second connector 30.

The metallic shell 40 of the cable connector assembly 100 is shielding the insulative housing 10, and die casted with a metallic plate. The metallic shell 40 is approximately of a cap and enclosing a front segment of the insulative housing 10. the metallic shell 40 includes a main portion 400, a pair of side portions 402 and a pair of flange portions 401 between the pair of side portions 402. The flange portions 401 are extending rearwards from an upper edge and a lower edge of the main portion 400. The main portion 400 of the metallic shell 40 defines a plurality of first notches 403 and a pair of second notches 404, the first notches 403 are rectangular and corresponding with the first cavities 122 and the third cavities 112, and the second notches 404 are circular and corresponding with the second cavity 123 and the fourth cavity 113. The metallic shell 40 defines an ear portion 405 on one of the side portion 402, and the ear portion 405 is adjacent to the mounting portion 116 of the insulative housing 10, and the ear portion 405 defines a fixing hole 4050 aligning with the through hole 1160 of the mounting portion 116. The fixing hole 4050 and the through hole 1160 are provided for a bolt (not shown) passing through. Each flange portion 401 defines a plurality of elastic portions 4010 protruding outwards, and a pair of cutouts 4011 are defined on each flange portion 401, the cutout 4011 is defined between two neighboring elastic portions 4010.

The cable connector assembly 100 has a capacitor 50 in the insulative housing 10, and the capacitor 50 is defined behind the second connectors 30. A first wire 60 is electrically connected with the two second connectors 30 via the first wire 60 is connected with at least one of the grounding legs 300, and a second wire 70 is connected the aforementioned grounding leg 300 with a linking point 500 on the capacitor 50, a third wire 80 is connected another linking point 501 of the capacitor 50 with the metallic shell 40, so the capacitor 50 is connected with the second connectors 30.

Referring to FIGS. 1-4, in assembly, the first connectors 20 are electrically connected with the cable via contacts (not shown), and the pair of second connectors 30 are connected to each other, then connected with the capacitor 50. The first wire 60 is connected with one of the grounding legs 300 of each second connectors 30 to make the two second connectors 30 connect with each other, and one end of the second wire 70 is connected with one of the aforementioned grounding legs 300, and the other end of the second wire 70 is connected with the linking point 500 of the capacitor 50. Then the first connectors 20 and the second connectors 30 are assembled to the corresponding first cavities 122 and the second cavity 123 of the bottom cover 12. The top cover 11 is assembled to the bottom cover 12 along the up-to-down direction, and the latch members 120 of the bottom cover 12 are locked with the corresponding tabs 111 of the top cover 11, the positioning posts 121 of the bottom cover 12 are inserted into the corresponding positioning holes 119 of the top cover 11, therefore the top cover 11 is assembled with the bottom cover 12 together.

The first connectors 20 are mounted in the first cavities 122 and the third cavities 112 simultaneity, and the second connectors 30 are received in the second cavity 123 and the fourth cavity 113, then the first connectors 20 and the second connectors 30 are exposed beyond a front surface of the insulative housing 10 with front ends thereof. Then the metallic shell 40 is assembled to the insulative housing along a front-to-back direction, and the first openings 403 and the second openings 404 are aligned with the corresponding first connectors 20 and second connectors 30. A plurality of second elastic portions 4012 on the flange portion 401 of the metallic shell 40 are received in and adjacent to the relative first sunken portion 127 and the second sunken portion 117, the first protrusions 128 and the second protrusions 118 are received in the corresponding cutouts 4011, the fixing hole 4050 in the ear portion 405 is aligned and cooperated with the through hole 1160 of the mounting portion 116, then the metallic shell 40 is stably assembled to the insulative housing 10. At last, the capacitor 50 is connected with the metallic shell 40 via the third wire 80 to achieve grounding effect.

The cable connector assembly 100 is mounted to a cage of a computer, as the capacitor 50 is defined behind the second connectors 30, the capacitor 50 can be connected with the second connectors 30 and the metallic shell 40 to achieve a better grounding effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. A cable connector assembly, comprising:

an insulative housing defining a plurality cavities;

at least a first connector received in a corresponding cavity;

a pair of second connectors received in other cavities;

a cable electrically connected with the first connector and the second connectors;

a metallic shell shielding on the insulative housing; and a capacitor defined in the insulative housing and assembled behind the second connectors, the capacitor including two linking points, both of the second connectors having a plurality of grounding legs electrically connected with each other, one linking point of the capacitor connected with one of the grounding legs of the second connectors, and the other linking point connected with the metallic shell.

2. The cable connector assembly as claimed in claim 1, wherein the first connector is a USB connector, and the second connector is an audio jack connector, the capacitor is connected with the pair of second connectors.

3. The cable connector assembly as claimed in claim 2, wherein a plurality of grounding legs are defined on a rear surface of the second connector, a first wire is connected with one grounding leg of each second connector with two ends.

4. The cable connector assembly as claimed in claim 3, wherein the cable connector assembly further comprises a second wire and a third wire, and the second wire is connected with one of the second connector and one linking point of the capacitor, the third wire is connected with another linking point of the capacitor and the metallic shell.

5. The cable connector assembly as claimed in claim 3, wherein the second wire and the first wire are connected with the same one grounding leg of the second connector.

6. The cable connector assembly as claimed in claim 1, wherein the metallic shell comprises a plurality of first elastic portions on a top surface and a bottom surface thereof and a plurality of second elastic portions in front of first elastic portions.

7. The cable connector assembly as claimed in claim 6, wherein the insulative housing comprises a plurality of sunken portions cooperated with the corresponding second elastic portions.

8. The cable connector assembly as claimed in claim 7, wherein the metallic shell comprises a plurality of cutouts in staggered relationship with the first elastic portions, the cutouts are recessed forwardly from a rear end of the metallic shell.

9. The connector assembly as claimed in claim 8, wherein the insulative housing has a plurality of protrusions mating the corresponding cutouts.

10. The connector assembly as claimed in claim 9, wherein insulative housing further comprises a plurality of ribs on lateral sides thereof.

11. An electrical connector assembly comprising:

a case including first and second halves assembled together to define a plurality of cavities therein;

a plurality of connectors disposed in the cavities, respectively;

a plurality of mating opening defined in a front face of the case for insertion of a plurality of corresponding plugs;

a plurality of outlets defined in a rear face of the case for extension of a plurality of cables;

a metallic shell enclosing most portions of the case; and a capacitor having one leg mechanically and electrically connected to a grounding contact of one of the connectors, and another leg mechanically and electrically connected to the shell.

12. The electrical connector assembly as claimed in claim 11, wherein the case defines a through hole, and the another leg extends through said through hole for fastening to the shell.

13. The electrical connector assembly as claimed in claim 12, wherein first and second halves are configured to be assembled to each other in a first direction while the shell is configured to be assembled to the case in a second direction which is perpendicular to said first direction and same with a mating direction defined from the front face to the rear face.

14. The electrical connector assembly as claimed in claim 11, wherein a wire is connected between the grounding contact of said one of the connectors and another grounding contact of another one of the connectors.

* * * * *